US007517394B2

(12) United States Patent
Bologa et al.

(10) Patent No.: US 7,517,394 B2
(45) Date of Patent: Apr. 14, 2009

(54) WET ELECTROSTATIC IONISING STEP IN AN ELECTROSTATIC DEPOSITION DEVICE

(75) Inventors: Andrei Bologa, Stutensee (DE); Thomas Waescher, Heidelberg (DE); Hanns-Rudolf Paur, Karlsruhe (DE); Ralf Arheidt, Karlsruhe (DE)

(73) Assignee: Forschungszentrum Karlsruhe GmbH, Karlsruhe (DE)

( * ) Notice: Subject to any disclaimer, the term of this patent is extended or adjusted under 35 U.S.C. 154(b) by 0 days.

(21) Appl. No.: 11/914,875

(22) PCT Filed: Mar. 11, 2006

(86) PCT No.: PCT/EP2006/002260

§ 371 (c)(1),
(2), (4) Date: Nov. 19, 2007

(87) PCT Pub. No.: WO2006/125485

PCT Pub. Date: Nov. 30, 2006

(65) Prior Publication Data

US 2008/0196590 A1 Aug. 21, 2008

(30) Foreign Application Priority Data

May 21, 2005 (DE) ..... 10 2005 023 521

(51) Int. Cl.
*B03C 3/014* (2006.01)
*B03C 3/49* (2006.01)

(52) U.S. Cl. ..... 96/52; 55/DIG. 38; 96/73; 96/83; 96/88; 96/97; 96/99

(58) Field of Classification Search ..... 96/52, 96/53, 69, 70, 73, 83, 88, 95–100; 55/DIG. 38
See application file for complete search history.

(56) References Cited

U.S. PATENT DOCUMENTS 1,130,212 A * 3/1915 Steere ..... 95/81

(Continued)

FOREIGN PATENT DOCUMENTS

DE 10132582 8/2002

(Continued)

*Primary Examiner*—Richard L Chiesa
(74) *Attorney, Agent, or Firm*—Darby & Darby

(57) ABSTRACT

A wet electrostatic ionization stage in an electrostatic separation device for purifying a flowing aerosal including finely dispersed particles entrained in a gas. The wet electrostatic ionization stage includes a plate disposed across a cross section of a flow channel and connected to a ground potential or reference counterpotential. The plate includes substantially identical openings through which the gas flows. The wet electrostatic ionization stage also includes a high-voltage grid disposed across the cross section of the flow channel either upstream or downstream from the plate and electrically isolated from a wall of the flow channel. The high voltage grid is coupled to a high voltage potential via a bushing disposed in the wall of the flow channel. For each opening in the plate, a rod-shaped high-voltage electrode coupled at one end to the high-voltage grid has a free end projecting centrically into the one opening. Each electrode includes a disk of electrically conductive material disposed on its free end. The disks are disposed in a substantially identical manner, each parallel to the plate, centrically with its corresponding opening and free from contact with the plate. The disks each include at least two outwardly extending radial tips. A sleeve is disposed in each opening. Each of the sleeves has a substantially identical cross section and an axis disposed substantially perpendicular to the plate. The sleeves are spaced circumferentially at a constant distance L from the radial tips.

19 Claims, 5 Drawing Sheets

U.S. PATENT DOCUMENTS

| | | | | | |
|---|---|---|---|---|---|
| 1,473,806 | A | * | 11/1923 | Bradley | 96/28 |
| 1,992,113 | A | * | 2/1935 | Anderson | 96/88 |
| 2,409,579 | A | * | 10/1946 | Meston | 96/97 |
| 3,765,154 | A | * | 10/1973 | Hardt et al. | 96/88 |
| 4,247,307 | A | | 1/1981 | Chang | |
| 4,449,159 | A | * | 5/1984 | Schwab et al. | 96/62 |
| 4,675,029 | A | * | 6/1987 | Norman et al. | 95/73 |
| 5,254,155 | A | * | 10/1993 | Mensi | 96/44 |
| 5,474,600 | A | * | 12/1995 | Volodina et al. | 96/57 |
| 6,228,149 | B1 | | 5/2001 | Alenichev et al. | |
| 6,294,003 | B1 | * | 9/2001 | Ray | 96/49 |
| 6,508,861 | B1 | * | 1/2003 | Ray | 95/79 |
| 6,527,829 | B1 | | 3/2003 | Malkamaki et al. | |
| 6,858,064 | B2 | | 2/2005 | Bologa et al. | |
| 7,101,424 | B2 | | 9/2006 | Wascher et al. | |
| 2004/0139853 | A1 | | 7/2004 | Bologa et al. | |

FOREIGN PATENT DOCUMENTS

| | | | | |
|---|---|---|---|---|
| DE | 10244051 | | | 11/2003 |
| JP | 56-78645 | A | * | 6/1981 |
| JP | 5-154408 | A | * | 6/1993 |
| JP | 2001198488 | | | 7/2001 |

* cited by examiner

Prior Art

WET ELECTROSTATIC IONISING STEP IN AN ELECTROSTATIC DEPOSITION DEVICE

CROSS REFERENCE TO RELATED APPLICATIONS

This is a U.S. National Phase application under 35 U.S.C. §371 of International Application No. PCT/EP2006/002260, filed on Mar. 11, 2006, and claims the benefit of German Patent Application No. 10 2005 023 521.2, filed on May 21, 2005, both of which are incorporated herein. The International Application was published in German on Nov. 30, 2006 as WO 2006/125485 A1 under PCT Article 221(2

FIELD OF THE INVENTION

The present invention relates to a wet electrostatic ionization stage in an electrostatic separation device for purifying an aerosol, i.e. a gas with finely dispersed liquid or solid particles entrained therein.

BACKGROUND

A wet electrostatic separator is a system which is installed in a conduit section of a gas flow control channel and which separates finely dispersed liquid or solid particles from a gas stream/aerosol stream. Devices of this kind are used in a broad range of fields.

The process of separating the finely dispersed particles from the gas stream includes the following steps:

electrostatic charging of the particles;

accumulating the charged particles at the surface of a collecting electrode or electrodes;

removing the charged particles from the surface of the collecting electrodes.

To electrostatically purify an aerosol, i.e. finely dispersed particles in a gas, it is customary to use negatively charged particles, i.e., ions. They are produced in a corona discharge process and form an actual electric current that flows through the air gap between an electrode that is at an electrically positive reference potential, typically ground potential, and a negative ionization electrode that is at an opposite electric potential. These electrodes are connected to a direct current-supplying high-voltage source having the requisite polarity. The value of the applied voltage is dependent on the distance between the electrodes and the properties of the gas stream to be processed.

The efficiency of an electrostatic separator is widely dependent on the intensity of the charge that is imparted by the charging section to the particles. The intensity of the charge can be enhanced by increasing the electrostatic field in the ionization section of the separator. The customary intensity maximum of the electrostatic field is limited at most to the value at which flashover begins.

In wet electrostatic separators, the ionization and collection zones are united in one system. The collection tubes are frequently long and therefore pose problems with respect to the alignment setting of the discharge electrodes. Also, the stability of the corona discharge in the ionization regions is affected by the washing/rinsing of the internal surface of the collector tubes with water. These problems are addressed in German Patents DE 101 32 582 C1 and DE 102 44 051 C1. They describe a wet electrostatic separator that includes separate ionization and collection regions. The particles are charged in an intensive electrostatic field via corona discharge processes. The corona discharge process takes place in the gap between needle or star electrodes and the openings/nozzle bores in the grounded plate when the needle or star electrodes are connected to DC high voltage. Oriented by the gas stream direction, the discharge electrodes project downstream in the gas stream into the openings/nozzle bores of the grounded plate. The charged particles are collected in the grounded tube bundle collector, which is disposed downstream in the gas stream from the high-voltage electrodes and is installed downstream in the gas stream from the ionization device.

A design of the wet electrostatic ionization stage is described in German Patent DE 101 44 051. It includes a plate which is connected to ground potential or to a positive reference/counterpotential, is mounted in a flow channel section across the inside cross section thereof, and which has a multiplicity of substantially identical openings to allow throughflow of the gas to be purified. It is followed downstream in the gas stream by a high-voltage grid, which is mounted in the channel section across the inside cross section thereof in electrical isolation therefrom, and which is connected to a high-voltage potential via a bushing in the wall of the channel section. A multiplicity of rod-shaped high-voltage electrodes corresponding in number to the openings are attached at one end to this high-voltage grid and are oriented thereto. Each of these high-voltage electrodes points toward or projects by its free end in a substantially identical manner, centrically into one opening/nozzle bore of the plate.

A disk made of or at least coated with electrically conductive material is located at each free end of such a high-voltage electrode, disposed centrally and in parallel to the plate, without contacting the same. Equally distributed over the periphery, it has at least two radial bulges/pointed tips, which are disposed radially or somewhat outwardly in a direction inclined toward the gas stream.

The operation of the wet electrostatic separator reveals that, in response to an increase in the applied voltage, i.e., in the electric field strength in the electrode gap, sparks are discharged between the electrodes and the edges of the openings/nozzle bores in correspondence with the inhomogeneous electric field. This reduces the efficiency of the particle charging and that of the particle collection in the electrostatic separator.

As shown in FIG. 5, a wet electrostatic ionization stage is made up of a multiplicity of high-voltage electrodes 1 in the form of rods which are connected by their one end to high-voltage grid 5 and have a star-shaped discharge electrode 2 mounted at the free end. Star-shaped discharge electrodes 2 are mounted axially in circular nozzle bores 3 of grounded plate 4, downstream or upstream in the gas stream from nozzle plate 4, at right angles to the direction of the gas stream. Numeral 6 denotes the nozzle bore axis.

Particle-charged gas flows through the nozzle bores. When the high voltage is applied to high-voltage grid 5, corona discharge is produced at the pointed tip locations of star-shaped electrodes 2. Gas 8 flows through the corona discharge zone; the entrained particles pick up a negative charge and exit the ionizer as negatively charged ions. It should be noted here that a positive electrical potential may, of course, also be applied to the high-voltage electrodes, and, as before, the plate may be connected to corresponding counterpotential, respectively, ground potential when the particles in the gas stream are more readily positively ionizable due to their chemical property. Finally, in certain applications, an AC high-voltage potential may also be applied to the high-voltage electrode, thereby at least entailing no technical outlay.

In an embodiment, the corona discharges may be driven at the highest possible intensity, without flashovers. As the applied voltage is increased, critical conditions are quickly reached, because the corona stream increases by approximately the square of the applied voltage. At the critical point, there is a sudden local transition from a high-field low-current-density discharge to a low-field high-current-density discharge, i.e., from a glow discharge to an arc discharge.

The entirely inhomogeneous electrostatic field between the pointed tips on star-shaped electrodes 2 and the outer end of nozzle bores 3 produces flashover discharges accompanied by decreasing efficiency of the particle charging and of the gas purification in wet electrostatic separators. The wet electrostatic ionization stage (see FIG. 5) is sensitive to the alignment setting of discharge electrodes 2 in nozzle bores 3. In the same way, the electric field of corona-discharge electrodes 2 in nozzle bores 3, which are disposed in close mutual proximity, can suppress the corona discharging at these electrodes. The result can be a decrease in the total corona stream between electrodes 2 and 3. As is discernible in FIG. 5, the corona points at the pointed tips of electrodes 2 can "see" each other, i.e., their generated fields can become mutually superposed and thereby mutually suppressed. The result is that the corona stream of the individual electrodes remains smaller than it would be if the electrode tips could not see each other.

SUMMARY

An aspect of the present invention is to provide an ionization stage for a wet electrostatic separator that is not characterized by the described, disadvantageous operating processes. The ionization stage of the present invention has a simple design, and its components are able to be reliably positioned, assembled, and respectively exchanged using few manipulations.

The present invention provides a wet electrostatic ionization stage in an electrostatic separation device for purifying a flowing aerosal including finely dispersed particles entrained in a gas. The wet electrostatic ionization stage includes a plate disposed across a cross section of a flow channel and connected to a ground potential or reference counterpotential. The plate includes substantially identical openings through which the gas flows. The wet electrostatic ionization stage also includes a high-voltage grid disposed across the cross section of the flow channel either upstream or downstream from the plate and electrically isolated from a wall of the flow channel. The high voltage grid is coupled to a high voltage potential via a bushing disposed in the wall of the flow channel. For each opening in the plate, a rod-shaped high-voltage electrode coupled at one end to the high-voltage grid has a free end projecting centrically into the one opening. Each electrode includes a disk of electrically conductive material disposed on its free end. The disks are disposed in a substantially identical manner, each parallel to the plate, centrically with its corresponding opening and free from contact with the plate. The disks each include at least two outwardly extending radial tips. A sleeve is disposed in each opening. Each of the sleeves have a substantially identical cross section and an axis disposed substantially perpendicular to the plate. The sleeves are spaced circumferentially at a constant distance L from the radial tips.

BRIEF DESCRIPTION OF THE DRAWINGS

The present invention will be described in greater detail in the following with respect to exemplary embodiments and drawings, in which.

DETAILED DESCRIPTION

Figure 1:
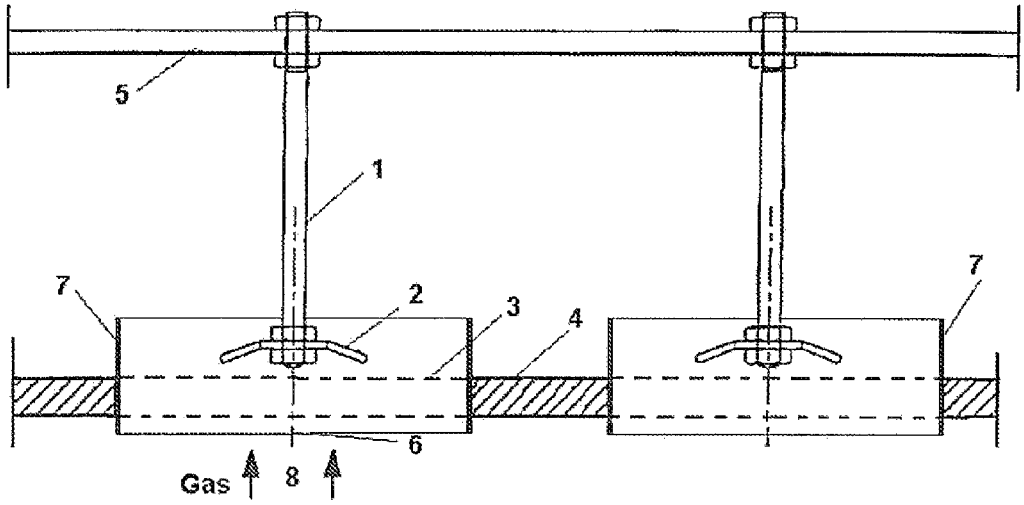
FIG. 1: shows a detail of the grounded plate having two sleeve-covered nozzle bores.
Figure 2:
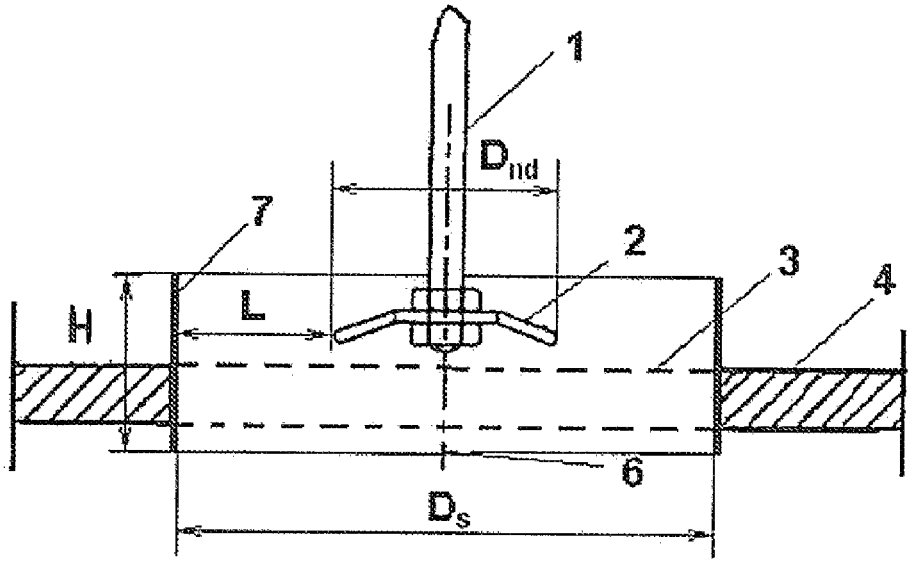
FIG. 2: shows a nozzle bore in detail.
Figure 3:
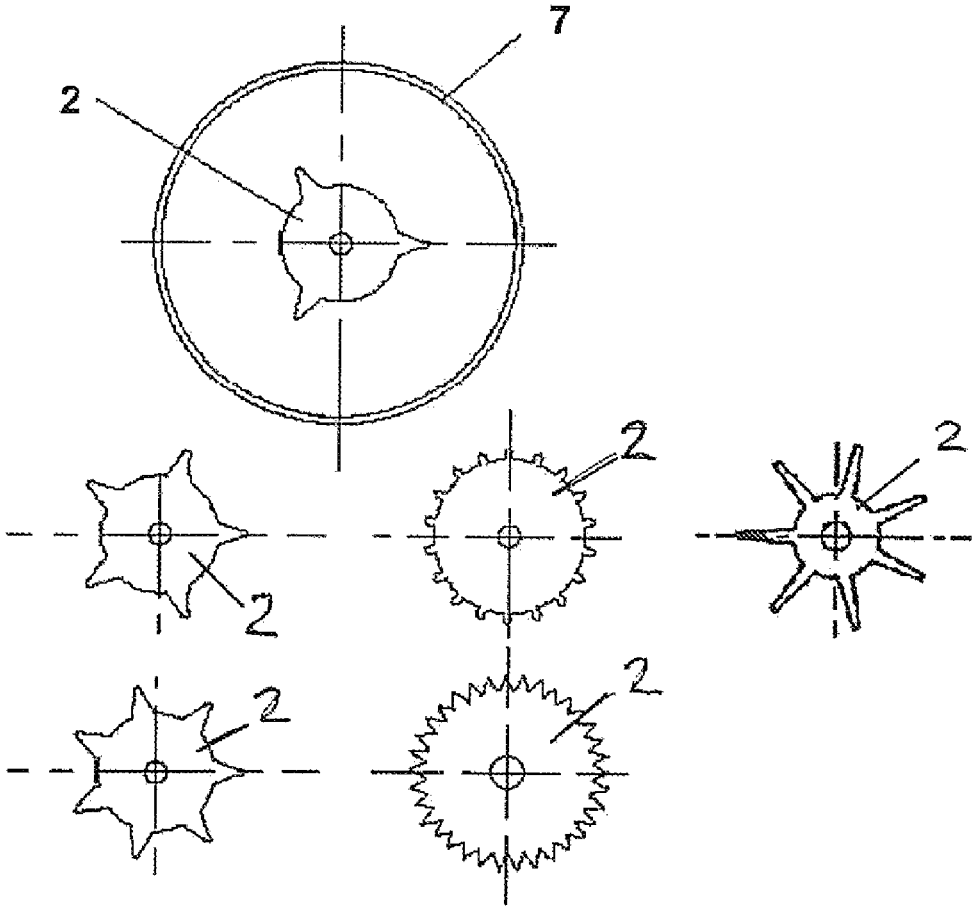
FIG. 3: shows various forms of the disk.

Through the use of the sleeves, the electrodes become encapsulated and mutually invisible. Each sleeve acts as a through-flow Faraday cage, in whose interior, a field is able to build up that is independent of the other electrodes. For the first time, a maintenance-free continuous operation is made possible by this measure.

In an embodiment, a sleeve is disposed in fitting engagement in each of the openings, also referred to as nozzle bores due to the flow processes during operation of the separator device. The sleeves are all held in substantially identical fitting engagement in their corresponding opening. The sleeves have a distended, simple convexly round, thus circular or elliptical/oval, or polygonal cross section and, thus, also an inside cross-sectional contour corresponding thereto. The sleeves fit or sit positively in the opening/nozzle bore and non-positively, thus with a force fit, at least to the point where they are not pulled out of their position in the nozzle plate by the separator that is designed for the most vigorous gas flow. With respect to axial positioning, this could be accomplished by at least one very shallow groove extending around the circumference of the sleeve and constricting the inside cross section there only minimally so as not to obstruct the gas flow, or, for example, by a hollow truncated-cone shaped or hollow pyramidal attachment, which embraces positively by the smaller opening and is seated thereon by the larger opening, is disposed coaxially to the sleeve, and which is soldered to the outer surface thereof or disposed with force fitting thereon to allow possible continuous axial displacement.

The sleeve axis and the axis of the rod-shaped high-voltage electrode extend on a shared line segment, i.e. they have a common axis. The disk secured to the free end of the high-voltage electrode projects centrically into the inside cross section of the sleeve and is disposed orthogonally to the flow axis of the traversing aerosol/of the gas to be purified. Together with the inner wall of the sleeve, it forms a circumferential, annular gap, which is the electrode gap between the high-voltage electrode and the nozzle plate that is at an opposite reference potential/counterpotential. Depending on the cross-sectional shape of the sleeve, a simple convex, round or polygonal envelope of disk 2 can be spaced circumferentially at a constant distance L from sleeve 7. At least the disk, or the disk together with the high-voltage electrode, may execute axial movement, so that, in any case, the disk may be axially positioned within the sleeve.

The position of the disk within the sleeve is limited to a range. The sleeve, which has a closed envelope surface and may be partially slotted, is described in geometric terms. Also provided is a sleeve attachment, which allows droplets, aided by gravity, to flow off along an edge to a lowest position, to finally fall off as drops. The material of the sleeves is described in terms of its electrical conductivity.

In accordance with an embodiment of the invention, the height/length of the sleeve in relation to gap width L between the electrodes is within the range of 0.5L<=H<=3L. In accordance with another embodiment of the invention, height H of the sleeve may be H=2L.

The high-voltage grid is located downstream in the gas stream from the plate that is at reference/counterpotential, respectively at ground potential. Thus, the high-voltage electrodes secured thereto project in a direction opposite the gas flow, respectively each of the free ends thereof point into an opening or a nozzle bore in this plate. The axial position of the disk mounted at the free end of the high-voltage electrode can be the range of 0.25H-0.75H, viewed, namely, from the flow outlet at the sleeve. In accordance with a specific embodiment the disk can be positioned at location 0.5H in the sleeve.

However, the high-voltage grid may also be located upstream in the gas stream from the plate that is at reference/counterpotential, respectively at ground potential. The high-voltage electrodes secured thereto then project in the direction of the gas flow, and each of the free ends thereof likewise point into an opening/a nozzle bore in this plate. A design is preferred which permits an electrically neutral process to be used to collect the falling drops.

The shape of the openings/nozzle bores in the plate, which is at reference potential, can be round as a circular form or elliptical/oval or the like, however, in an external view, at least simply convex or distended. The sleeve may also have a polygonal cross section, for example a regular polygonal cross section such as hexagonal, as well as octagonal cross sections. Irregular cross-sectional shapes may also be used.

The sleeve may be tubular as well, meaning that it is described as having a closed envelope surface and, thus, as a technically simplest shape, it has a circular or polygonal. From an electrical standpoint, the triangular cross section is not very practical since a type of point-plate electrode configuration would result in a significant increase in the flashover at the three pointed tips.

Starting out from the gas flow outlet, the sleeve may have a longitudinal slot extending upstream in the gas stream at least from the partial height of height H of the sleeve. In one embodiment, the width S of the slot may be in a range of 0.05<=S<=0.2H. In accordance with a specific embodiment, its width S is preferably =01H. In the case of the continuous slot, the sleeve may be cut out/punched from one plane sheet-metal section and rolled into a sleeve in two simple fabrication steps.

The moisture and charged particles to be separated settle on the inner wall of the sleeve where they discharge. The particles, which have been electrically neutralized there, continue to flow in the direction of gravity to the edge of the sleeve where large drops form and fall off upon reaching a critical size. This process may be aided by an attachment at this edge. In accordance with one embodiment, at its bottom face in terms of its spatial position, each sleeve has an enveloping, oblique or obliquely canted, concavely chamfered attachment, at whose unattached face/edge, liquid droplets flow off toward the lowest position where they form into drops, which, upon reaching critical size/weight, fall off downwards due to accumulated mass. Another simple droplet-collecting configuration is achieved in another embodiment, where, at its bottom face in terms of its spatial position, the sleeve, namely, has a crown of pointed tips, which are uniformly distributed over the periphery, point downwards or point obliquely downwards, and on which collected drops again fall off downwards, pulled by the force of gravity, upon reaching critical mass. In a further improvement of the drop fall-off process that has the least effect on the gas stream, the pointed tips are outwardly bent at an angle of 0-45°.

In addition to its process-inert properties, the sleeve material must be rigid enough in terms of allowing for the flow, and elastic enough to ensure a form-locking force fit. This may be accomplished using electrically conductive material, for example metallic, or a composite material having a conductive component, such as a carbon-fiber composite. Preferably, the surface of the sleeve is smooth to allow the electric field conditions in the electrode gap of the nozzle bore to be easily maintained and in the manner intended.

Given adequate moisture in the separator such that every sleeve is coated on its surface with at least one cohesive liquid film up to the nozzle plate, and the liquid is electrically conductive, the sleeve may also be made of semiconductive or even of dielectric material having requisite mechanical properties suited for the process. In all cases, however, the material can be suited for the process, i.e., besides having the requisite mechanical and electrical properties, it can also be chemically inert in the process environment.

The present invention provides a wet electrostatic ionization section which overcomes the disadvantages of other systems. The wet electrostatic ionization section exhibits a high degree of efficiency and achieves a requisite high level of particle separation. The wet electrostatic ionization section is able to be manufactured competitively and to industry standards. The wet electrostatic ionization section has a simple design, is easy to operate and simple to assemble. The wet electrostatic ionization section does not rerelease separated liquid into the gas stream.

In an embodiment shown in FIGS. 1-4, the sleeves are disposed in fitting engagement in the plate that is at reference potentional and have a simple circular cross section. The gas stream flows upwards from spatially below. High-voltage grid 5 having electrodes 1 mounted thereon is located downstream in the gas stream from the grounded plate, thus above plate 4. In response to electrical neutralization, separated droplets and/or particles fall off downwards along sleeves 7 fittingly disposed in plate 4.

Figure 4A:
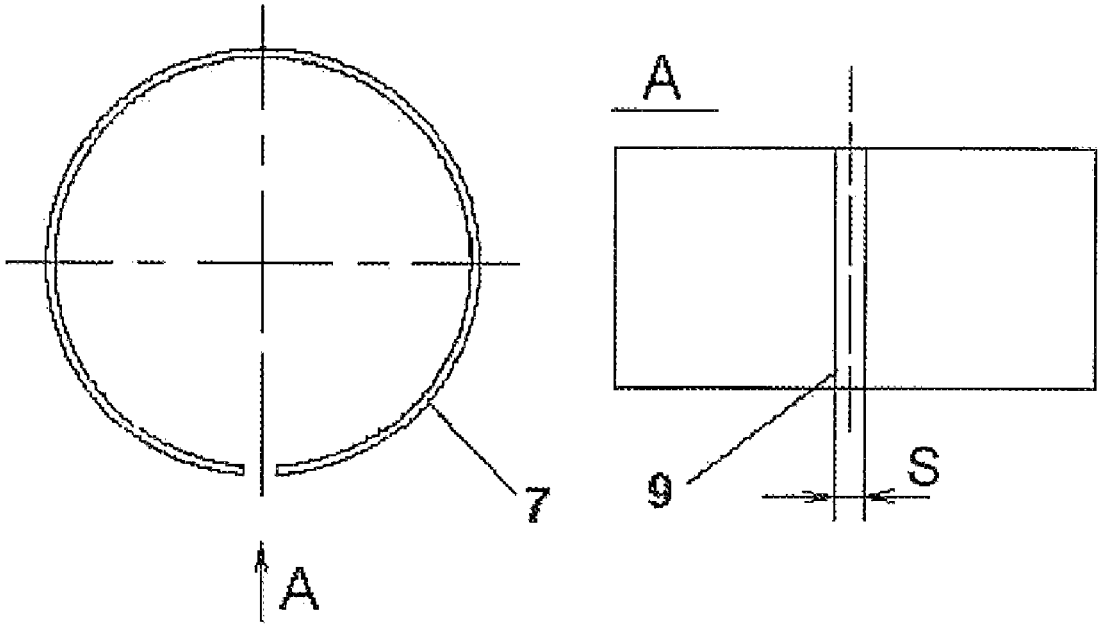
FIG. 4*a*: shows the longitudinally slotted sleeve with a continuous gap.

The relative proportions of sleeves 7 having a circular cross section are $0.5 \leqq H \leqq 3L$, L being=$(D_s - D_{nd})/2$ of the electrode gap between disk 2 and the inner surface of sleeve 7, $D_s$ being the inside diameter of sleeve 7, $D_{nd}$ being the outside diameter of disk 2. In a more specific embodiment, the height of sleeve 7 can be 0.25<=H<=1.5L. Disks 2 are positioned in sleeves 7 at a height of (0.25-0.75)H below the gas stream outlet of sleeves 7. Disks 2 are preferably positioned at a height of 0.5H. Disks 2 have the form of star-shaped electrodes having a plurality of corona-inducing pointed tips. The circular sleeves may be provided with a gap 10 in the lateral surface of sleeve 7 (FIG. 4*b*) and with a continuous gap 9—thus equal to the height of sleeve 7 (FIG. 4*a*). Width S of gap 9, 10 in the sleeve is 0.05H<=S<=0.2H, H being the height or the length of sleeve 7. In a specific embodiment, gap width S in the sleeve is S=0.1H.

To allow the droplets that have accumulated on the inner surface of sleeves 7 to drip off, bottom part 11 is chamfered (FIG. 4*c*), for example at a horizontal angle α of between 10 and 50° relative to axis 6 of sleeves 7. For example, the angle can be α=25-45°. The shape of the chamfer cut may be varied. To allow for effective flow off and drip off processes, sleeves 7 are designed as liquid collectors and drop formers, and include needle-shaped bottom angles 13 (FIG. 4*d*), and may additionally be bent obliquely downwards and outwardly, in this case against the flow.

Therefore, to overcome the shortcomings of the wet electrostatic ionization stage according to the related art, a multiplicity of conductive circular sleeves 7 are incorporated in such a manner that star-shaped high-voltage electrodes 2 in sleeves 7 are positioned at a predefined height under the outlet of sleeves 7 in direction 8 of the gas stream (FIG. 1). When the potential is applied to disks 2, the ionizing electrostatic field is established between the pointed tips of electrode/disk 2 and the inner surface of sleeve 7. This kind of ionization system geometry increases the discharge flashover voltage and improves the stability of the ionization stage operation. Thus, the corona stream may be increased. The use of sleeves 7 renders the ionization stage insensitive to the configuration of the angles/edges of nozzle bores 3 because incorporated sleeves 7 do not permit flashover among disk 2, the star-shaped electrode, and the edges of nozzle bores 3. Sleeves 7 in nozzle bores 3 make the ionization stage in axial direction 6 of nozzle bores 3 less sensitive to the alignment setting of disks/discharge electrodes 2. Sleeves 7 concentrate the electric field in each nozzle bore 3 between discharge electrode 2 and the inner surface of the corresponding sleeve. Sleeves 7 eliminate the mutual influence of the fields of adjacent disks/electrodes 2. High-current corona discharging at electrodes 2 is suppressed.

Circular sleeves 7 may be made from thin-walled, short tubes or from a piece of conductive strip. Sleeve 7 may be immovably installed to dimension in nozzle bore 3, or its position may be altered relative to nozzle plate 4 in the direction of axis 6 of nozzle bores 3.

To ensure effective corona discharging and charging of the particles, it is provided that length H of the sleeve (FIG. 2) be $0.5<=H<=3L$, L being$=(D_s-D_{nd})/2$ of the electrode gap between the discharge electrode and the inner surface of the sleeve; $D_s$ being the inside/clear diameter of the sleeve, and $D_{nd}$ being the outside diameter of the discharge electrode. Preferred height H of the sleeve is H=2L. When the height of sleeve H is <0.5L, there is a greater probability of flashover discharging between the pointed tip locations of disk/star-shaped electrode 2 and the edges of the sleeves. When H>3L, flashover discharges may initiate.

To maintain a stable operation at the highest possible voltage without the occurrence of flashover discharges between the pointed tips of star-shaped electrodes 2 and the edges of sleeves 7, the discharge electrodes may be oriented in the sleeves at a height of (0.25-0.75)H below the flow outlet of the sleeves in the direction of the gas flow of the sleeves, preferably at a height of 0.5H below the outlet of the sleeves.

Star-shaped electrodes 2, which are mounted in sleeves 7, may be fabricated with different numbers of pointed tip locations, from where the corona discharge develops. Given the same diameter $D_{nd}$ of the star-shaped electrode, the corona stream increases, on the one hand, with the number of pointed tip locations on disk 2. On the other hand, the electric field lines in the gap very quickly become smooth toward sleeve 7, approaching the cross-sectional shape of the sleeve, thereby accommodating the desired corona discharge.

Figure 4B:
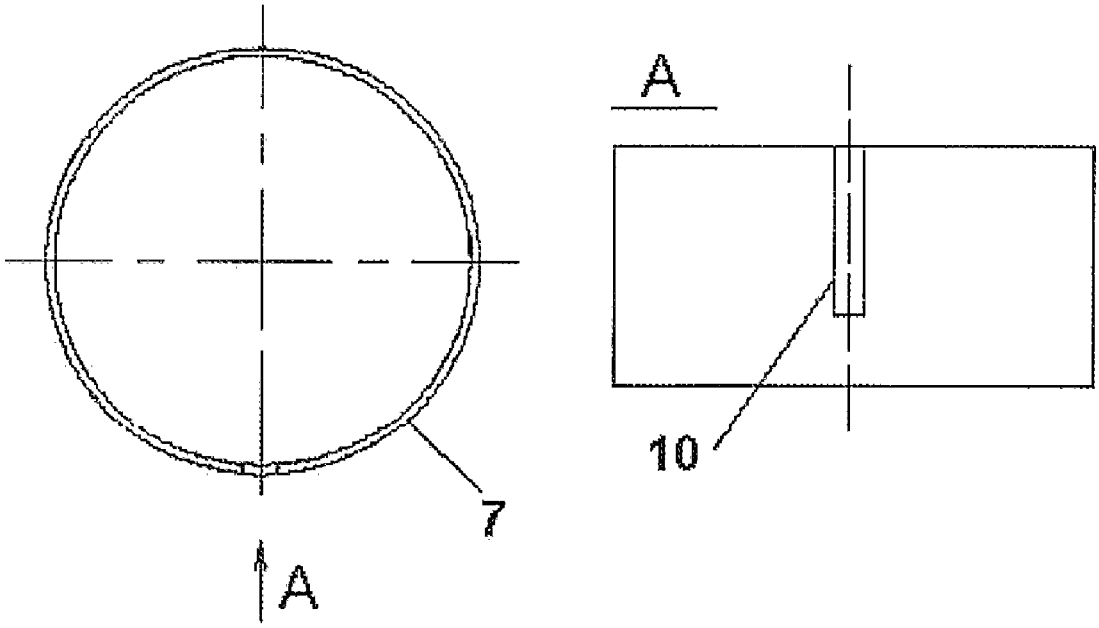
FIG. 4*b*: shows the longitudinally slotted sleeve with a gap in the lateral surface.
Figure 4C:
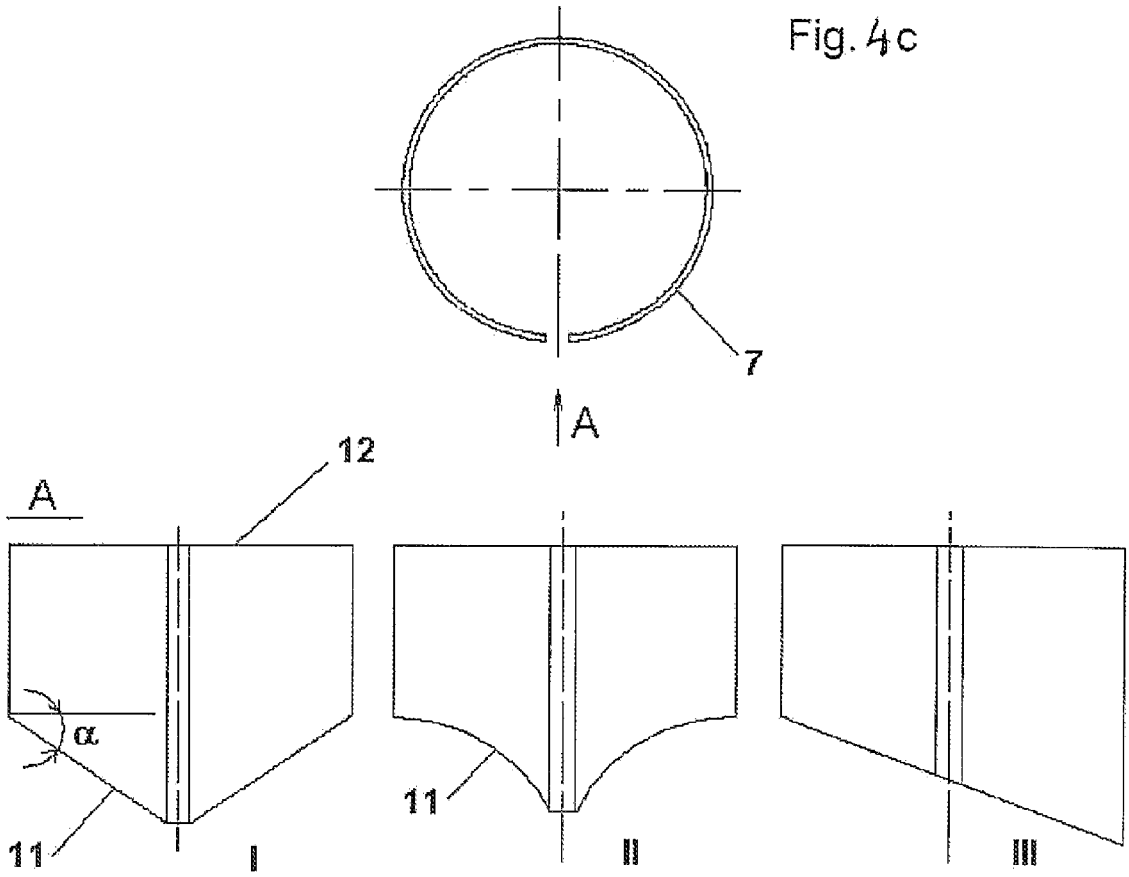
FIG. 4*c*: shows the longitudinally slotted sleeve with a chamfered bottom part.

To prevent any clogging due to particle accumulation in the sleeves, the sleeves of the wet electrostatic ionization stage are provided with a gap/slot in the lateral surface. The height of the slot is equal to the height of the sleeve (FIGS. 4*a* and 4*b*). The water that has collected on the top surface of grounded nozzle plate 4 is discharged through slots 9 in sleeves 7. To maintain a stable operation without the occurrence of flashover discharges between discharge electrodes 2 and the edges of slot 9, it has proven beneficial to retain width S of the slot in the sleeve within the range of $0.05H<=S<=0.2H$, H being the height/length of the sleeve; slot width S preferably being=0.1H.

Figure 4D:
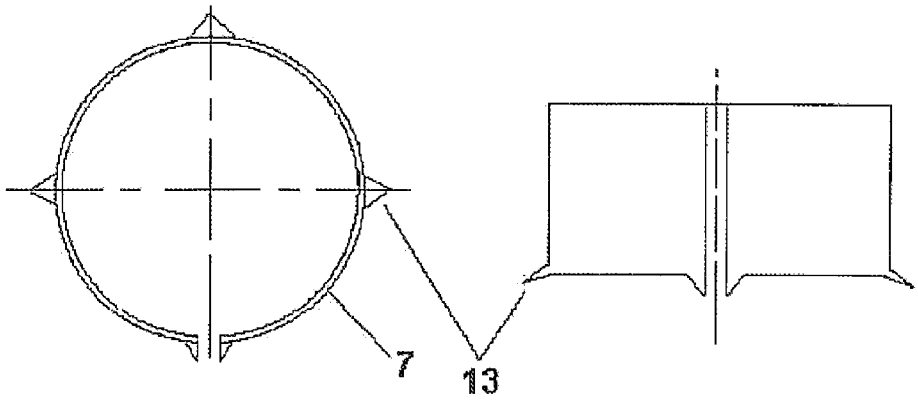
FIG. 4*d*: shows the longitudinally slotted sleeve with needle-shaped bottom angles.
Figure 5:
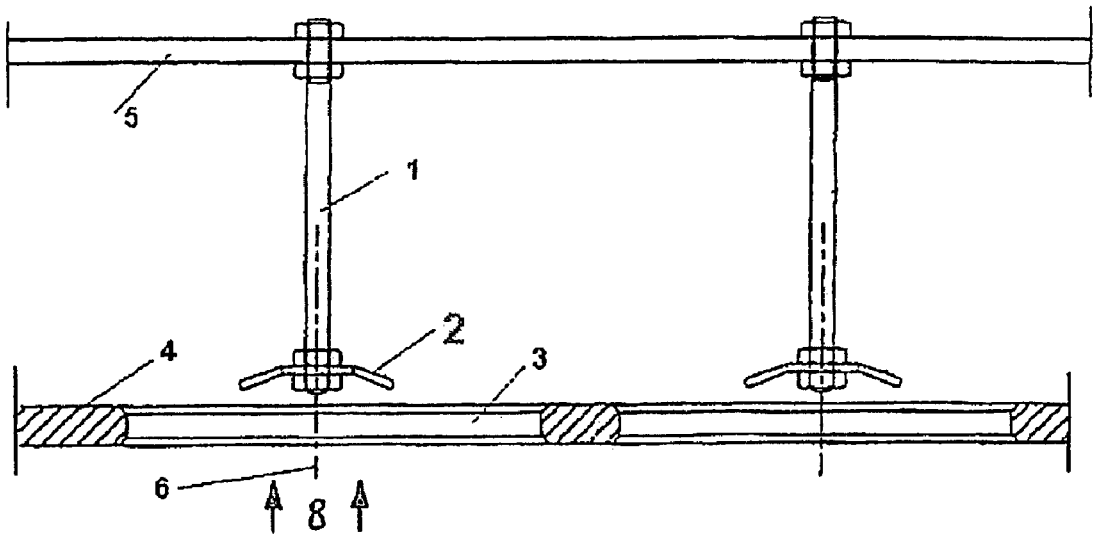
FIG. 5: shows a prior art detail of the grounded plate having two nozzle bores.

Outwardly bending the drip-off edge places it in a region of substantially lower flow velocity, largely suppressing the "entrainment" of the drop upwards in the direction of flow, which would otherwise jeopardize the flashover. Due to their contact with the inner edge of the sleeve, the outwardly deflected drops smooth out the constantly present water film. The liquid which collects at bottom edges 11 of the sleeves is discharged by needles 13 in the form of large drops falling off downwards (FIG. 4*d*).

In response to an increase in the applied voltage between sleeve 7 and electrode/disk 2 positioned therein, corona discharges are initiated from the needles of star-shaped electrodes 2. Depending on the formation of the electrostatic field in the electrode gap, the corona stream and thus the efficiency of the electrostatic charging of particles may be increased. A portion of the charged droplets is collected on the inner surface of the sleeves. The droplets, which collect on the inner surface of the sleeves, form a liquid film. The other portion continues to flow and is deposited in a grounded tube precipitator disposed downstream in the direction of the gas stream.

A specific embodiment of sleeve 7 made of stainless steel and having a circular cross section and a continuous longitudinal gap, and of five-pronged electrode 2, the disk, is indicated in the following:

| | |
|---|---|
| the height or length of the sleeve is | H = 20 mm; |
| the outside diameter of the sleeve is | D = 50 mm; |
| the inside diameter of the sleeve is | $D_s$ = 48 mm; |
| thus, the wall thickness of the sleeve is | $T_s$ = 1 mm; |
| the external contour diameter of the disk is | $D_{nd}$ = 30 mm; |
| the electrode gap is | $L = (D_s - D_{nd})/2$ = 9 mm; |
| the sleeve gap is | S = 2 mm. |

LIST OF REFERENCE NUMERALS

1 high-voltage electrode
2 disk
3 opening, nozzle bore
4 plate
5 high-voltage grid
6 axis
7 sleeve
8 direction
9 slot
10 slot
11 chamfer cut
12 edge
13 pointed tip

The invention claimed is:

1. A wet electrostatic ionization stage in an electrostatic separation device for purifying a flowing aerosal including finely dispersed particles entrained in a gas, the wet electrostatic ionization stage comprising:

a plate disposed across a cross section of a flow channel and connected to one of a ground potential and reference counterpotential, the plate comprising a plurality of substantially identical openings configured to allow the gas to flow therethrough;

a high-voltage grid disposed across the cross section of the flow channel in electrical isolation from a wall of the flow channel downstream or upstream relative to the plate, the high-voltage grid being coupled to a high-voltage potential via a bushing disposed in the wall of the flow channel;

a respective rod-shaped high-voltage electrode corresponding to each of the plurality of openings and coupled at one end thereof to the high-voltage grid, each electrode including a free end projecting centrically into the respective opening;

a respective disk of electrically conductive material disposed at the free end of each electrode, the disks being disposed in a substantially identical manner parallel to the plate, centrically with a corresponding opening and free from contact with the plate, each disk including at least two outwardly extending radial tips; and a respective sleeve disposed in each of the plurality of openings, the sleeves each having a substantially identical cross section and an axis disposed substantially perpendicular to the plate, each sleeve being spaced circumferentially at a constant distance L from the corresponding radial tips.

2. The wet electrostatic ionization stage as recited in claim 1 wherein each of the sleeves has a height H in the range of 0.5L to 3L.

3. The wet electrostatic ionization stage as recited in claim 2 wherein the height H is about 2L.

4. The wet electrostatic ionization stage as recited in claim 2 wherein each of the disks is flush-fitted in the corresponding sleeve and disposed at a height with respect to the corresponding sleeve in the range of 0.25H to 0.75H.

5. The wet electrostatic ionization stage as recited in claim 4 wherein each of the disks is disposed at a height with respect to the corresponding sleeve of about 0.5H.

6. The wet electrostatic ionization stage as recited in claim 1 wherein each of the sleeves is tubular.

7. The wet electrostatic ionization stage as recited in claim 2 wherein each of the sleeves is tubular.

8. The wet electrostatic ionization stage as recited in claim 4 wherein each of the sleeves is tubular.

9. The wet electrostatic ionization stage as recited in claim 1 wherein each of the sleeves includes a longitudinal slot extending at least part of the height of the sleeve from a gas flow outlet side.

10. The wet electrostatic ionization stage as recited in claim 2 wherein each of the sleeves includes a longitudinal slot extending at least part of the height of the sleeve from a gas flow outlet side.

11. The wet electrostatic ionization stage as recited in claim 4 wherein each of the sleeves includes a longitudinal slot extending at least part of the height of the sleeve from a gas flow outlet side.

12. The wet electrostatic ionization stage as recited in claim 11 wherein the slot has a width in the range of 0.05H to 0.2H.

13. The wet electrostatic ionization stage as recited in claim 12 wherein the slot has a width of about 0.1H.

14. The wet electrostatic ionization stage as recited in claim 2 wherein each of the sleeves includes a bottom face having an enveloping, oblique, obliquely canted or concavely chamfered attachment, the attachment including an unattached face with a lowest portion operable to provide a location to which liquid droplets flow and drop downward from the sleeve.

15. The wet electrostatic ionization stage as recited in claim 2 wherein each of the sleeves includes a bottom face including a crown of uniformly peripherally distributed pointed tips operable to provide a location at which formed drops reach a critical weight and fall off downwards.

16. The wet electrostatic ionization stage as recited in claim 15 wherein the pointed tips extend downward.

17. The wet electrostatic ionization stage as recited in claim 15 wherein the pointed tips extend obliquely downward and outward.

18. The wet electrostatic ionization stage as recited in claim 15 wherein each of the sleeves comprises an electrically conductive material.

19. The wet electrostatic ionization stage as recited in claim 15 wherein each of the sleeves comprises an electrically dielectric material.

* * * * *